United States Patent [19]

Thomas

[11] 4,289,306

[45] Sep. 15, 1981

[54] EXERCISE WHEEL

[76] Inventor: Ross T. Thomas, 1507 Lincoln, Corona, Calif. 91720

[21] Appl. No.: 89,604

[22] Filed: Oct. 29, 1979

[51] Int. Cl.[3] ..... A63G 1/12

[52] U.S. Cl. ..... 272/33 R; 272/146

[58] Field of Search ..... 46/26, 31; 272/33 R, 272/33 A, 93, 109, 111, 146

[56] References Cited

U.S. PATENT DOCUMENTS

| | | | |
|---|---|---|---|
| 2,878,858 | 3/1959 | Winchester | 272/33 A |
| 3,000,134 | 9/1961 | Marini | 246/26 |
| 3,262,701 | 7/1966 | Howland | 272/146 X |
| 3,302,949 | 2/1967 | Wolfe | 46/426 X |
| 3,612,520 | 10/1971 | Chang et al. | 272/146 |
| 3,649,007 | 3/1972 | Thomas | 272/33 R |

FOREIGN PATENT DOCUMENTS

| | | | |
|---|---|---|---|
| 448838 | 4/1968 | Switzerland | 272/146 |
| 528273 | 11/1972 | Switzerland | 272/146 |
| 1203664 | 9/1970 | United Kingdom | 272/146 |

*Primary Examiner*—Richard J. Apley
*Attorney, Agent, or Firm*—William C. Babcock

[57] ABSTRACT

An improved structure and method of assembly for an exercise wheel of the type described in my U.S. Pat. No. 3,649,007 includes an upper circular support surface conformed to mate with a lower support surface at the periphery, the peripheral edges of the upper and lower surfaces being provided with peripherally overhanging lips dimensioned to be engaged by a semicircular vinyl extrusion which includes interior keying projection for joining the surfaces together. Integral with the surfaces are a plurality of radial ribs, each surface including such ribs in corresponding opposed locations, which upon assembly are aligned relative each other. Formed centrally on the underside of the lower surface is a flange boss to which a pipe flange is secured engaging one end of a pipe supporting a post about which the wheel rotates.

6 Claims, 7 Drawing Figures

FIG. 1
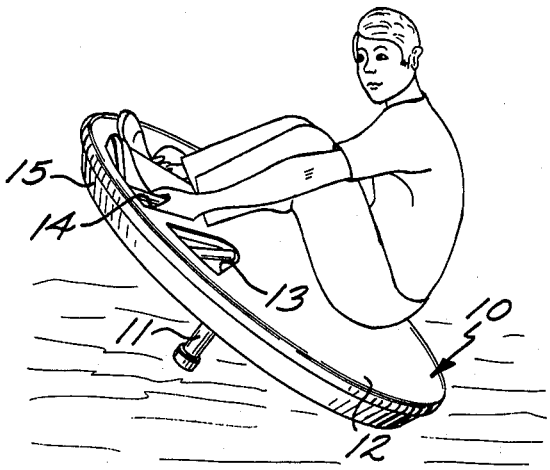
FIG. 2
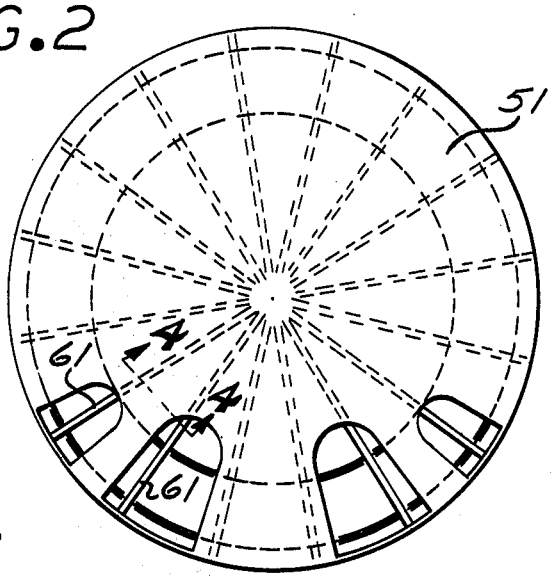
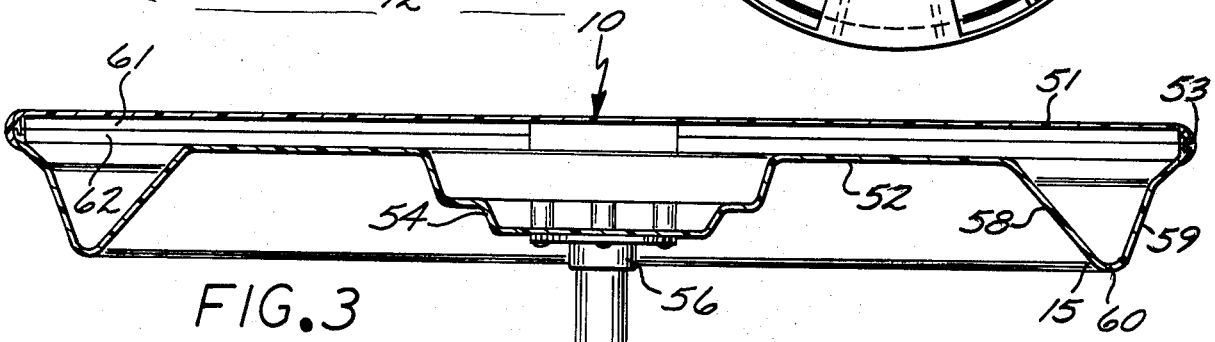
FIG. 3
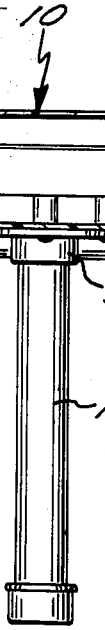
FIG. 4
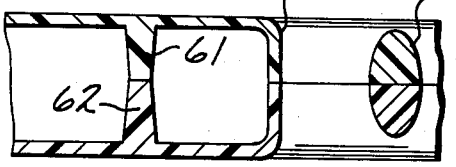
FIG. 5
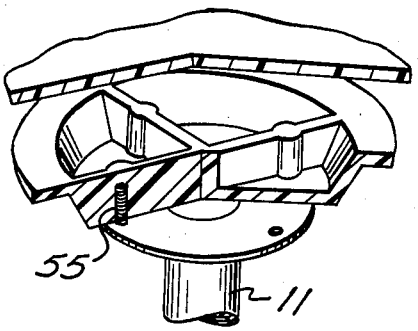
FIG. 6
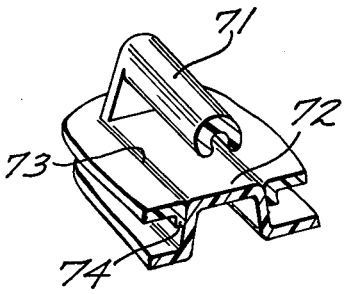
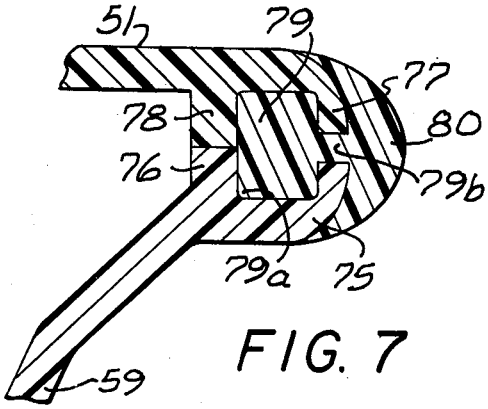
FIG. 7

EXERCISE WHEEL

BACKGROUND OF THE INVENTION

1. Field of the Invention

The present invention relates to improvements in exercise devices, and more particularly to an improved construction technique for an exercise wheel.

2. Description of the Prior Art

In my prior U.S. Pat. No. 3,649,007 issued Mar. 14, 1972, I have described an exercise device wherein a wheel is supported on a center post and is rotated by a person sitting thereon. In order to add stiffness to the wheel on which the person is supported I have previously inserted a plurality of radial spokes on the interior of two surfaces forming an enclosure, these spokes also forming hand holds when exposed through cutouts in the enveloping surface. Since that time I have found that further improvements can be made to the foregoing structure, both to achieve manufacturing convenience and to enhance the operation of the device. In particular I have found that the foregoing exercise device can be made from two plastic castings with the necessary stiffening structure integrated therein. Furthermore I have found that these same plastic castings can include surface convolutions to provide additional clearance around the rim to reduce rolling friction and to protect the inserted feet from inadvertent injury. As result of the foregoing improvements, I have found that the cost of manufacture of the device can be greatly reduced and the safety and the utility thereof can be further enhanced.

SUMMARY OF THE INVENTION

Accordingly it is the general purpose and object of the present invention to provide an exercise wheel formed in the manner of two mating halves, the periphery of each half having keyed surfaces for retention by a peripheral ring.

Further objects of the invention are to provide an exercise wheel which is conformed for convenient casting out of plastic.

Yet additional objects of the invention are to provide an exercise wheel which includes a lower peripheral support envelope to reduce the rolling friction thereof.

Briefly these and other objects are accomplished within the present invention by forming an exercise wheel out of two mating surfaces cast to the surface to include the necessary hand and foot receiving openings. The lower surface casting is provided with a peripheral cavity for serving as a foot rest and providing a raised peripheral rolling bead. The lower surface, furthermore, includes a central boss provided with the necessary tapped openings for securing a pipe flange. Received within this pipe flange is a length of pipe which forms the center post supporting the wheel. Thus the wheel rolls around the end of the center post, the peripheral bead providing a narrow edge to reduce rolling contact. Both the lower and the upper surfaces furthermore include radial stiffening ribs on their mating faces, the radial disposition of the ribs in the lower surface coinciding with the ribs in the upper surface. In one embodiment these same ribs extend exposed in hand hold cutouts formed in the upper surface, thus providing grasping structures therein. The upper and lower surface castings have upper and lower mating circular ribs adjacent the periphery of the upper surface casting being defined by a downwardly curving lip, and the periphery of the lower surface casting by an upwardly curving lip. The lips on the upper and lower surface castings are spaced from one another and also radially spaced from the circular ribs. The lips and ribs cooperate to define a circular confined space of rectangular transverse cross section, which confined space is in communication with a transverse gap situated between the adjoining ends of the lips. A circular resilient extrusion is provided that is of generally T-shape transverse cross section, which includes an anchor portion disposed in the confined space, a neck that extends outwardly through the gap, and a crescent shaped portion that removably grips the curved lips to hold the upper and lower surface castings together as an integral unit.

BRIEF DESCRIPTION OF THE DRAWINGS

FIG. 1 is a perspective illustration of an exercise wheel including the improvements set out herein;

FIG. 2 is a plan view of one embodiment of an exercise wheel constructed according to the present invention;

FIG. 3 is a sectional view of the improved wheel shown in FIG. 2;

FIG. 4 is a detail view in section taken along Line 4—4 of FIG. 2;

FIG. 5 is a diagrammatic view, in section, of a support boss constructed according to the present invention;

FIG. 6 is a detail view of an alternative hand hold implementation utilizing the features of assembly set forth herein; and FIG. 7 is an enlarged, transverse fragmentary cross sectional view of an edge portion of the invention.

DESCRIPTION OF THE SPECIFIC EMBODIMENT

As shown in FIG. 1 both my previously disclosed exercise wheel and the wheel set out herein, by the numeral 10 includes a stub shaft 11 extending orthogonally from a circular support structure 12. Included in the support structure 12 are two hand hold cutouts 13 and two foot cutouts 14. It is through these cutouts that the person using the exercise wheel extends his limbs to manipulate the wheel. While quite suitable for this purpose it has been found that inadvertent limb extension may occur through the cutouts with the possibility of injury becoming real. Thus the present wheel 10 includes a peripheral convolution 15 on the underside of structure 12 for the second contact point with ground.

As shown in FIGS. 2 through 5 and 7 the implementation of the present wheel 10 includes two circular upper and lower surface halves 51 and 52 joined at their respective peripheries by a flexible peripheral extrusion 53. The lower surface half 52 furthermore includes a central boss 54 on the exterior thereof, boss 54 being provided with a plurality of bolt holes 55 for securing a pipe flange 56 thereto. It is this pipe flange 56 that engages one end of the support or stub shaft 11 thus providing the necessary mounting interface therefor.

Formed on the underside of structure 12 and comprising a convolved part of surface half 52 is the foregoing peripheral convolution 15 aligned to surround boss 54. More specifically convolution 15 is made as a triangular surface section of a circular planform having an internal conical surface frustum 58 joined to an external conical frustum 59 by a rounded apex bead 60. It is the curvature of bead 60 and the conical taper of frustum 58 that limit the size of the ground contact area, thus reducing rolling friction. Extending radially along the interior faces of surface halves 51 and 52, in equal increments of arc, are radial strengthening ribs 61 and 62, respectively, each rib forming an abutting edge parallel to the mating plane of the surface halves for adhesive joining.

As shown in FIGS. 2 and 4 the segments of ribs 61 and 62 extending through openings 13 and 14 are rounded to form hand holds 61(*a*). By alternative implementation, such as that shown in FIG. 6, a hand hold 71 is formed on the interior face of surface 52, the surface being convolved in that location to form a rectangular projection 72 extending into the interior of a rectangular opening 73 in the upper surface 51. For purposes of structural engagement the peripheral edge of opening 73 is turned inwardly to form a lip 74, the interior dimensions bounded by the peripheral lip opposing the upward progression of the rectangular support or projection 72. Thus the hand hold 71 extending above projection 72 transfers forces to the lower surface half 52 maintaining the two surfaces together during use. In this manner the structural integrity of wheel 10 is not dependent on adhesive, reducing the cost and complexity of the assembly process.

The assembly sequence is further simplified by the implementation of the peripheral juncture between upper and lower surface halves 51 and 52. More specifically lower surface half 52 includes a rounded edge lip 75 radially outside an interior peripheral ring 76 formed between the radial ends of ribs 62. Similarly upper surface half 51 includes a rounded edge lip 77 radially distal a peripheral ring 78. Lips 75 and 77 extend to less than the full edge thickness of surfaces 51 and 52 and therefore form a radial gap therebetween. This gap communicates with a circular confined space formed between the rings 77 and 78 and the adjacent lips 75 and 77. Received in this confined space and extending through the gap is a T shaped extrusion 79. The extrusion 79 includes a circular anchor 79*a* of generally rectangular transverse cross section that is disposed in the confined space as shown in FIG. 7 from which a tensioned neck 79*b* extends through the gap to support a crescent shaped member 80 in removable gripping contact with the upper and lower lips 77 and 75.

By way of the foregoing parts, a convenient assembly sequence is achieved wherein the surface halves 51 and 52 are radially aligned through the alignment of the exposed rib segments forming the hand hold 61*a* and are axially brought together by the edge strip 53. Edge strip 53 may be made of a flexible material structure like Vinyl, the primary function thereof being to provide the necessary retaining forces and not to transfer load. To further reduce any loading of the edge strip 53 during use rings 76 and 78 may be keyed, ring 76 for example extending beyond the mating plane while ring 78 is recessed by the amount of the foregoing extension.

This configuration of surface halves 51 and 52 is particularly adapted for casting out of a plastic like ABS incorporating all of the foregoing features in integral structures which are manually aligned for joining and secured by the peripheral strip.

The surface halves 51 and 52 as well as other components of the invention may be formed of a desired commercially available polymerized resin by the core foam nitrogen agitated process, with each of the components so formed having a tough outer skin and a core structure of a desired density. The invention may also be formed as an integral unit, rather than from components that are bonded together.

Obviously many modifications and variations to the above disclosure can be made without departing from the spirit of the invention. It is therefore intended that the scope of the invention be determined solely on the claims appended hereto.

What is claimed is:

1. In an exercising device that includes a circular platform that has a periphery on which it rolls, a stub shaft projecting outwardly from the center of said platform, said stub shaft having a free end, said free end and periphery cooperating when a user is mounted on said platform to roll on a flat surface in a circular path about the contact of said free end with said flat surface by said user shifting his weight, the improvement comprising:

a. an upper surface half that has an upper surface and a lower surface, and an outer periphery defined by a downwardly curved first lip, a first ring of greater depth than said first lip that extends downwardly from said lower surface and is radially spaced from said first lip, said upper half having a pair of foot receiving openings and a pair of hand receiving openings therein;

b. a lower surface half of the same diameter as said upper half, said lower surface half having an upper surface and a lower surface, a periphery defined by a second curved lip that extends upwardly therefrom, a second ring that extends upwardly from said upper surface of said lower surface half, said second ring of greater depth than said second curved lip, said lower surface half having a circular convolution that extends downwardly adjacent said second curved lip, and a boss that extends downwardly from substantially the center of said lower surface half;

c. a pipe flange secured to said boss and that receives said stub shaft;

d. a circular resilient strip that in transverse cross section defines a rectangular anchor, a neck extending outwardly from said anchor, and a crescent shaped member that has said neck secured to substantially the center thereof, said upper and lower surface halves when said first and second rings are disposed in abuting contact defining a circular confined space in cooperation with said first and second lips in which said anchor is disposed with said neck extending through a gap defined between said first and second curved lips, and said crescent shaped member engaging said first and second curved lips to removably hold said first and second half surfaces together as an integral unit.

2. An exercising device as defined in claim 1, which in addition includes;

e. first and second radial mating ribs that project from said lower surface of said upper surface half and said upper surface of said lower surface half.

3. An exercising device as defined in claim 2, in which said upper surface half has a pair of cut outs over said convolution to form a cavity for surrounding the lower limb portions of a user.

4. An exercising device as defined in claim 3, in which the portion of said ribs in said cut outs are rounded to provide hand holds for said user.

5. An exercising device as defined in claim 3, in which said lower surface half has hand holds that extend upwardly therefrom through openings in said upper surface half.

6. An exercising device as defined in claim 1, in which said upper and lower surface halves are formed from plastic.

* * * * *